US012111128B2

(12) United States Patent
Moore et al.

(10) Patent No.: US 12,111,128 B2
(45) Date of Patent: Oct. 8, 2024

(54) SEMI-AUTOMATIC SHOTPISTOL SHELL PISTOL

(71) Applicants: Daniel Patrick Moore, Pacolet, SC (US); Patrick David Moore, Pacolet, SC (US)

(72) Inventors: Daniel Patrick Moore, Pacolet, SC (US); Patrick David Moore, Pacolet, SC (US)

( * ) Notice: Subject to any disclaimer, the term of this patent is extended or adjusted under 35 U.S.C. 154(b) by 295 days.

(21) Appl. No.: 17/573,591

(22) Filed: Jan. 11, 2022

(65) Prior Publication Data

US 2023/0221086 A1 Jul. 13, 2023

(51) Int. Cl.

| | |
|---|---|
| ***F41A 3/66*** | (2006.01) |
| ***F41A 3/46*** | (2006.01) |
| ***F41A 3/82*** | (2006.01) |
| ***F41C 27/06*** | (2006.01) |

(52) U.S. Cl.
CPC ..... *F41A 3/82* (2013.01); *F41A 3/46* (2013.01); *F41A 3/66* (2013.01); *F41C 27/06* (2013.01)

(58) Field of Classification Search
CPC ..... F41A 3/82; F41A 3/80; F41A 3/78; F41A 3/66
USPC ..... 89/198
See application file for complete search history.

(56) References Cited

U.S. PATENT DOCUMENTS

| | | | | |
|---|---|---|---|---|
| 2,921,502 A * | 1/1960 | Amsler | F41A 19/43 89/149 |
| 10,605,553 B1 * | 3/2020 | Collazo | F41C 7/00 |
| 2022/0170713 A1 * | 6/2022 | Wilkinson | F41A 3/26 |

* cited by examiner

*Primary Examiner* — Reginald S Tillman, Jr.

(57) ABSTRACT

This patent relates to a smooth bore barrel, replaceable magazine fed, semi-automatic pistol weighing at least 5 pounds for discharging of slug, shot, or crowd control/specialty loads of at least 12-gauge (18.5 mm), 1.75-inch (42 mm) shell loads with a recoil energy less than 45 ft-lbs.

17 Claims, 6 Drawing Sheets

FIG. 7

| ITEM NO. | PART NAME | QTY. |
|---|---|---|
| 1 | Lower Receiver | 1 |
| 2 | AR-Trigger | 1 |
| 3 | AR-Disconnector | 1 |
| 4 | AR-Hammer | 1 |
| 5 | Magazine release | 1 |
| 6 | Magazine release button | 1 |
| 7 | AR 15 grip screw | 1 |
| 8 | AR 15 compatible pistol grip | 1 |
| 9 | Upper Receiver | 1 |
| 10 | Barrel | 1 |
| 11 | Shell | 1 |
| 12 | Barrel | 1 |
| 13 | Charging rod | 1 |
| 14 | Charging handle screw | 1 |
| 15 | Folding charging handle | 1 |
| 16 | Charging handle pin | 1 |
| 17 | Bolt Carrier | 1 |
| 18 | Delayed bolt lock roller | 1 |
| 19 | Bolt lock roller | 1 |
| 20 | Bolt | 1 |
| 21 | Firing pin | 1 |
| 22 | Bolt retention pin | 1 |
| 23 | Extractor claw pin | 1 |
| 24 | Extractor claw | 1 |
| 25 | Firing pin retention pin | 1 |
| 26 | Roller pin | 2 |
| 27 | Guide rod plate | 1 |
| 28 | Recoil rod A | 1 |
| 29 | Recoil rod B | 1 |
| 30 | Bolt Buffer spring | 2 |
| 31 | Magazine | 1 |
| 32 | Magazine base | 1 |
| 33 | Magazine follower | 1 |

SEMI-AUTOMATIC SHOTPISTOL SHELL PISTOL

DESCRIPTION OF DRAWINGS

Page1/6 FIG. 1 Right hand side view of pistol with spent shell ejection port Page2/6 FIG. 2 Cut away view with parts identified Page3/6 FIGS. 3A and 3B Details of bolt carrier group, bolt, recoil springs, shell extraction guide rod, bolt lock roller, firing pin, and extractor claw Page 4/6 FIG. 4 Cut away detail of shell extraction guide rod, recoil spring, rebound buffer, barrel with shell chamber, and magazine shell follower Page5/6 FIG. 5 Front view with manual shell charge handle, barrel, and magazine release button and FIG. 6 Rear view with hand grip Page 6/6 Table of identified part numbers and names

BACKGROUND

Figure 1:
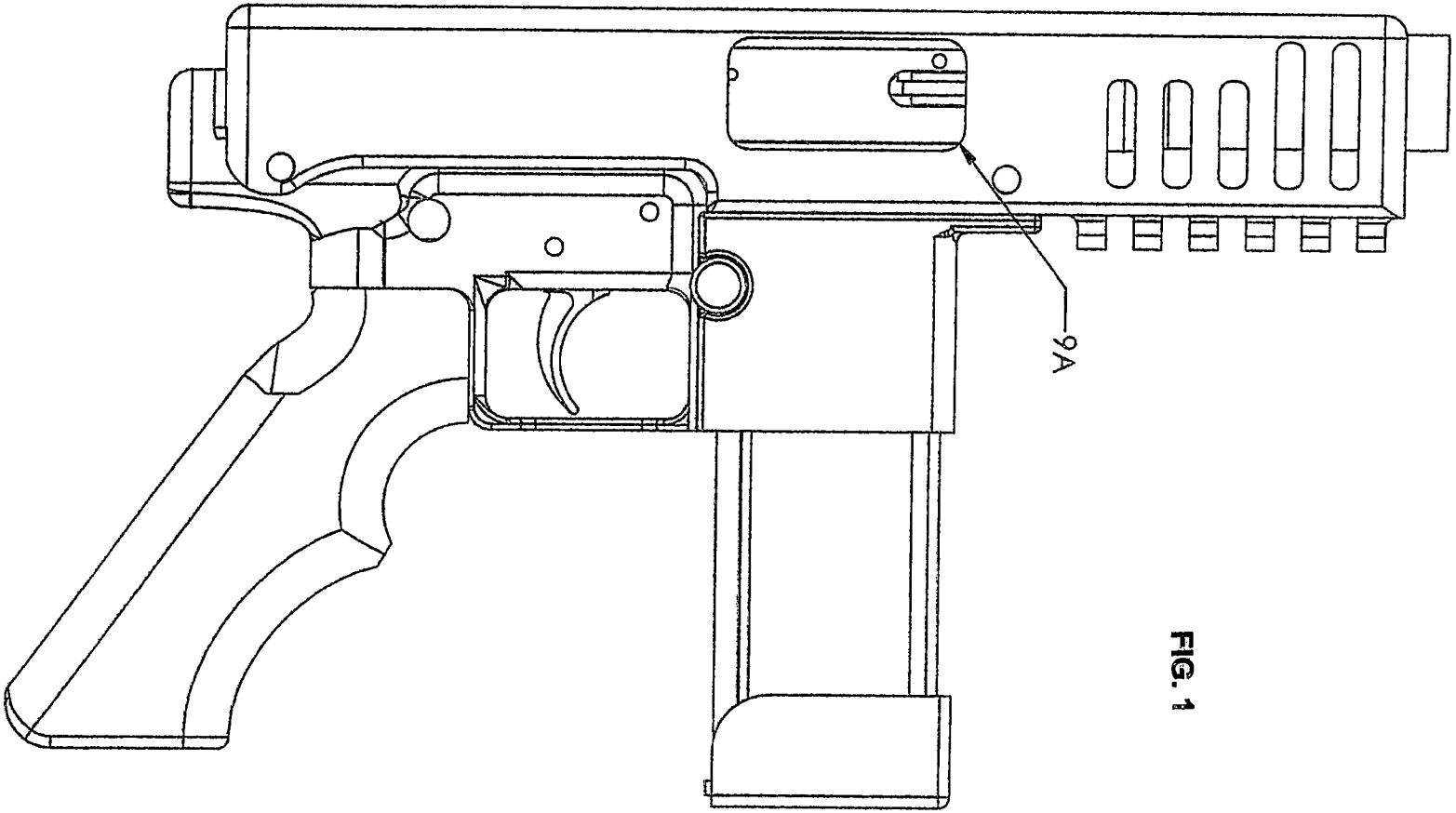

Semi-automatic refers to a firearm design that when the trigger is pulled with a shell in the barrel chamber, part of the energy from the discharge is used to eject the spent shell, cock the hammer, and move a fresh shell from a magazine containing a multitude of shells into the barrel chamber. Each pull of the trigger will then produce a discharge until the magazine is empty. A magazine is a replaceable/reloadable container for fresh shells that attaches to the firearm in such a way as to supply shells into the firing position upon each discharge.

Semiautomatic pistols, for standard pistol ammunition, that use a portion of the discharge pressure gases to propel a sliding breech-bolt to cock the hammer, eject the spent cartridge shell, present a new shell into the chamber of the barrel, and automatically lock the breech, each time the trigger is pulled, are known see USP 984,519.

A key design feature of these inertial powered pistols is a slight delay between the discharge of the propellent and the unlocking of the breech. This delay allows the projectile to experience maximum gas pressure/acceleration while within the barrel and dramatically reduces the force applied to the subsequently unlocked breech. It is obvious from the following observations that an unlocked breech at firing would be dangerous. An initially unlocked breech would be propelled backward with a speed proportional to the ratio of its mass to the mass of the projectile. As an unlocked breech moves rearward the shell casing must contain the gas pressure present. Modern propellants can generate gas pressures well above 10,000 psi in the firearm shell chamber. The resulting bursting of ammunition shell casing could impact the user with fragments and high temperature gases. At 12-gauge diameter, 10,000 psi translates to about 4,200 pounds of force on the bolt. The desired unlock delay time depends on the pressure versus time curve produced by the propellent detonation confined between the breech, barrel interior volume, and the projectile. Typical pressure curves rise rapidly upon detonation then begin to fall as the projectile is accelerated down the barrel. A dramatic pressure drop then occurs when the projectile exits the end of the barrel. This process is clocked in milli seconds. Many methods and designs exist than can delay the unlocking of the breech at the appropriate time when the gas pressure is safe but sufficient to propel the cycle of the bolt carrier assembly. For example, reference USP 984,519 and U.S. Pat. No. 7,299,737. The delayed blowback roller system (FIG. 3*a* #18 and #19) is preferred due to its simplicity and durability. This system that has one or more symmetrically positioned roller and ramp components operates to delay the unlocking of the breech by the following example description. Starting from the unlocked position, with the bolt carrier group (BCG) moving forward under spring recoil impulse to chamber a shell. The roller assembly attached to the bolt rides between the bottom surface of the upper assembly and the lowest edge of the angle of the ramp machined into the BCG. As the bolt face nears the shell chamber rear limit, a machined indentation or "nest chamber" in the upper receiver is in position to allow the roller to rise along the BCG ramp to lock the bolt in its closed position. The BCG, held by the recoil spring tension, then moves into direct contact with the rear of the bolt. Upon detonation of the propellent, a rearward impulse is transferred thru the locked bolt mass to the BCG. The BCG begins moving rearward, opening the gap between the bottom of the locked roller and the top of the ramp incline. When the rearward motion of the BCG allows the top of the roller to clear the bottom of the upper receiver nest chamber, the bolt is released to move rearward under the impulse of the residual gas pressure. The BCG ramp angle, the diameter of the roller and nest dimensions determines the delay time before the bolt is free to recoil.

The historical object of using a firearm is strike a target at a distance with a high-speed projectile. The higher the barrel exit speed the faster the projectile reaches the target and the greater its effective range. The higher the barrel exit speed the less time elapses between firing and the projectile reaching its target. This reduces the deviation of the projectile in flight from gravity and wind while also improving the ability to hit a moving target. Previously, the application of firearms is to kill or wound a target with high speed, high momentum projectiles. These projectiles are intended to penetrate an animal body and can exit through a target. In policing, wildlife, and crowd control, less lethal but still highly effective projectiles are desirable. The small barrel diameter of current pistols limits the size and mass of their projectiles. Examples of less lethal handheld firearm projectiles include plastic slugs, pepper spray pellets, Tasers, and chemical sprays, these have very limited effective range and target impact.

There is a need for a large diameter pistol barrel with intermediate power with effective target impact at short range with standard metal pellets or far less likely to be fatal with slower speed, penetration resistant projectile sizes and designs. Crowd control projectiles include marking dyes, impact plastic pellets, low energy darts, paintball type mini balloons that burst on impact, and various entanglement schemes.

Pistols are single hand short barrel (2 to 12 inch) firearms used to engage targets at close quarters or in confined spaces. Pistols are moderate target precision firearms as defined by the distance at which a skilled operator can reliably strike a human adult size target. The requirements to control, aim, and fire without injury to the user imposes a combination of design limits on handheld pistols. The key consideration is the hand and arm strength of the typical user. The forces that must be controlled by the user include the weight of the firearm held from close-by to arm length, the discharge recoil "kickback" produced from the combination of powder charge, projectile mass, and magnitude and duration of gas pressure within the barrel, and rotational force resulting from the height of the barrel above the hand grip. The commercial success of particular designs of handgun and projectile weight, the propellent charge, and the barrel length defines the limits of single hand controllable pistols.

They range from 0.22 to 0.50 caliber projectiles and the corresponding size of propellent charge, barrels, and magazines. There are many examples, well known in the art, of designs that meet these requirements of pistols.

Modern pistols have spiral grooves on the inside surface of the barrels (rifling) to impart stabilizing spin to cylindrical slug projectiles. The rifled barrel greatly enhances the distance and accuracy of the firearm when using cylindrical slug projectiles. In contrast, ammunition containing a multitude of spherical shot encased in plastic or metal sleeves that match the physical size of the corresponding pistol slug ammunition, when fired through a rifled pistol barrel have centrifugal force imparted to the individual spherical projectiles that spreads the emerging pellets and defeats effective targeting at distances over about 5 feet. The small volume of pistol slugs limits the size and number of spherical pellets that can be placed within the slug volume. There is a need for pistols with smooth bore barrels to make effective use of shells containing a multitude of spherical shot.

Shotguns are smooth bore barrel low target precision firearms that can be used to great effect to distances up to 50 meters and are preferred when targeting isolated small or moving objects. As the name implies, shotguns typically use ammunition that contain a multitude of spherical shot contained in a blunt nose cylindrical sleeve. The multitude of shot emerging from the end of the barrel produce an expanding cone of projectiles, each of which has the potential to strike the target. This expanding cone of projectiles greatly improves the opportunity for at least one projectile to strike the target compared to a single slug projectile that must arrive at the same time and place of a target where such slug projectiles can only strike targets within the fixed diameter of the slug projectile along its trajectory. This difference between multiple shot and single slug projectiles translates directly into required relative firearm control precision. The greater the distance from a target the greater precision of firearm control is required for a slug projectile. The low precision of the expanding cone of pellets improves target impact probability until the distance where the spread between individual pellets exceeds the target size.

Modern shot pellets are typically made from lead or steel, the individual size, total number, and resulting total shot mass are varied according to the desired application. The massive bodily damage produced by shotguns at short range limits their use in military and policing except for high hazard (return fire in close quarters) and group intimidation applications. The growing need for less lethal but powerfully effective firearms has led to the that replacement metal shot with rubber pellets or fabric pouches of pellets. These less lethal applications include personal protection, wildlife, and riot deterrence. There is particularly a growing need to provide police officers with additional options to subdue individuals without causing permanent injury or death to the target, and at the same time, provide effective personal protection to the officer. The shotgun shell barrel provides a convenient space to propel shapes and assemblies that are customized for that outcome.

Most shotguns have long barrels (16 inch or more) and are shoulder fired like a rifle. The gauge is a parameter indicative of the barrel inner diameter. According to conventional system for hunting, the gauge is a number mostly 12 or 20, more rarely 28, which indicates how many lead balls with the inner diameter of the barrel are contained in one pound. The smaller the gauge the larger the barrel diameter. Shotguns with barrel diameters larger than the 12-gauge shotgun barrel diameter are known but not common due to the severe recoil or "kickback" during discharge. The recoil or "kickback" feature is the rearward momentum (measured in units of ft-lbs) produced from, and directly proportional to, the propellant discharge pressure, the mass of the powder and shot projectiles, and the length of the barrel and inversely proportional to the weight of the firearm. It is well known that the discharge energy (measured from 17 to 54 ft-lbs), from a conventional 12-gauge shotgun weighing 7.5 lbs, using common shotgun shells, produces a powerful "kickback", strong enough to bruise unpadded shoulders. In comparison, a typical 9 mm handgun weighs 2.0 lbs and produces 3.8 ft-lbs of discharge energy. The common, more powerful, handguns like the 45 colt and the 357 magnum weigh 2.75 lbs. and produce 7.0 and 7.9 ft lbs. of recoil respectively. It is easy to see that a handgun weighing 2.75 lbs but firing standard 12-gauge shotgun shells would produce generally uncontrollable 46 to 147 ft-lbs of recoil. Control of a pistol firearm requires that the recoil "kickback" not exceed the single hand grip and arm strength of the user. There are 0.50 caliber extreme handguns weighing 4.5 lbs with recoil energy of 45 ft-lbs that may be considered near the upper limit of recoil energy for practical handguns. These extreme handguns have large hand grips to limit potential users to larger, stronger, and heavier individuals. Pistol wrist braces are well known and provide additional control of the firearm during discharge and mitigate recoil force impacts on the user by bridging the upper rear of the pistol firearm to a contact pad resting on the arm of the user past their wrist joint. The use of a wrist brace allows a greater range of hand grip and arm strength individuals to safely control high recoil energy handguns. There are a wide variety of pistol wrist brace designs available to meet the preferences of the user.

The inventive term "shotpistol" shell describes a cylindrical shotgun shell style cartridge at least 12-gauge that contains the combination of propellant charge and projectile assembly weight that when fired from a matching gauge smooth bore pistol style firearm weighing at least 5 pounds produces a maximum recoil energy of less than 45 ft-lbs.

Semiautomatic Shotguns

A type of semi-automatic shotgun is that called "gas-operated". In such a shotgun, the energy of the gases developed by the powder explosion is exploited. A small part of such gases is drawn from the barrel through one or more holes, in order to generate expansion inside a cylinder closed by a sliding piston. The piston thrust generates, in turn, an impulse which re-cocks the mobile masses, ejects the shell, and loads the new ammunition. Pistols with this type of design are also known. (U.S. Pat. No. 5,448,940)

Another type of semi-automatic shotgun is the one called the "inertial" type. In this type of shotgun, the compression and the subsequent relief of a spring that is arranged between the mobile masses and the shotgun frame are exploited. The spring compression is caused by the shotgun recoil, and it is exploited to confer to the same masses the required re-cocking speed.

The shotgun with inertial operation is appreciated because it allows for the limiting of the maximum re-cocking speeds and the resulting reduction of the stresses of the mechanical parts, as well as, limiting the exposure of internal parts to expended gasses that can produce fouling.

A further type of semi-automatic shotgun, historically the first to developed, is that called "barrel long recoil" type or, more simply, "long recoil". In such type of shotgun, the natural recoil exerted by the gas thrust is exploited to backwardly accelerate the barrel and the side-bolt assembly therewith, and all the mases involved in the re-cocking movement. Suitable unlock devices located between the barrel and the bolt provide to disconnect, at the right moment, the barrel from the locking members. The moment to disconnect the barrel from the locking members is somewhat delayed compared to the moment when the shot leaves the muzzle and, as a result, the pressure inside the barrel is drastically decreased. Thereafter, a return spring brings the barrel back to initial position, (called the battery position), while the momentum of the slide-bolt assembly, provided with its own return spring, provides for the operations of shell ejection and reloading of new ammunition.

Multiple Shot Shell and Magazine Designs

There are known single or dual barrel smooth bore pistol style firearms that utilize single shotgun shell ammunition manually fed into a hinged barrel, also, antique muzzle loading firearms that can be loaded with powder and shot projectiles. It is obvious that multi-shot firearms (greater than 3) are superior to single or dual shot shell firearms in their ability to immediately re-engage targets. Multi-shot revolver style smooth bore pistols are known but typically utilize smaller gauge (0.410 or smaller) shotgun shells and suffer in holster practicality due to the large diameter required of the revolving cylinder, additionally, reloading requires slow manual placing of individual cartridges in the empty cylinder rather than the rapid exchange of preloaded magazines. Tubular shell magazines underneath and parallel to the barrel are not suitable for short barrel pistol firearms due to the limited number of shells in such a corresponding short tube magazine and the slow reload process of manual insertion of single shells into the tubular magazine.

Magazines with shells within the hand grip of semiautomatic rifled barrel handguns are well known for ammunition up to 45 caliber (11.45 mm diameter by 23 mm length). This design is unsuitable for a smooth bore pistol with 12-gauge or larger shells due to the necessary width of a hand grip, containing a magazine of such shells, that exceeds the comfortable grip size of most hands. The use of standard 12-gauge 18.5 mm diameter and 2.5 in (60 mm) to 3.5 in (80 mm) length ammunition has been restricted to shoulder fired firearms due to the more powerful discharge typically beyond hand grip strength. New "mini" 12-gauge 18.5 mm diameter and 1.6 in (38 mm) length) shells with a proportional reduction in the propellant and shot charge model a new class of shotpistol shells. This reduction in power coupled with the much shorter barrel length of a pistol could provide for an acceptable handheld recoil energy.

Pistols carried as sidearms are preferred over long barrel firearms in any application where hands are normally employed in some mobile activity but ready access to a firearm may be required, especially in policing and wildlife control. Shotpistol shells could provide these applications with increased target striking probability due the expanding cone of standard metal pellet charges or hard hitting less lethal outcomes using specially designed loads.

From the above background, there is a need for a sidearm capable, single hand controllable, 12-gauge or larger shotpistol shell using, multi-shot (3 or more), replaceable magazine fed, semiautomatic smooth bore pistol.

SUMMARY OF INVENTION

This invention provides for exceptionally large diameter shotpistol ammunition to be semiautomatically discharged from a pistol firearm that can be carried as a sidearm. An object of the present invention is to devise and provide a semiautomatic smooth bore pistol weighing at least 5 pounds, powered by delayed blowback inertial impulse that utilizes at least 12-gauge shotpistol ammunition that produces between 0.2 and 45 ft-lbs of recoil energy. A further object of this invention is to provide a replaceable magazine containing a multitude of at least 12-gauge shells and both a semi-automatic and manual chambering mechanism with shell feed structures from a perpendicular magazine forward of the grip and trigger. The offhand manual feed mechanism allows for control of the firearm during reload. A further object is to provide for bolt carrier group guide rod assisted ejection of the heavy spent shotpistol shell. A further object is to provide an optional stabilizing wrist brace.

DETAILED DESCRIPTION OF THE INVENTION

Figure 2:
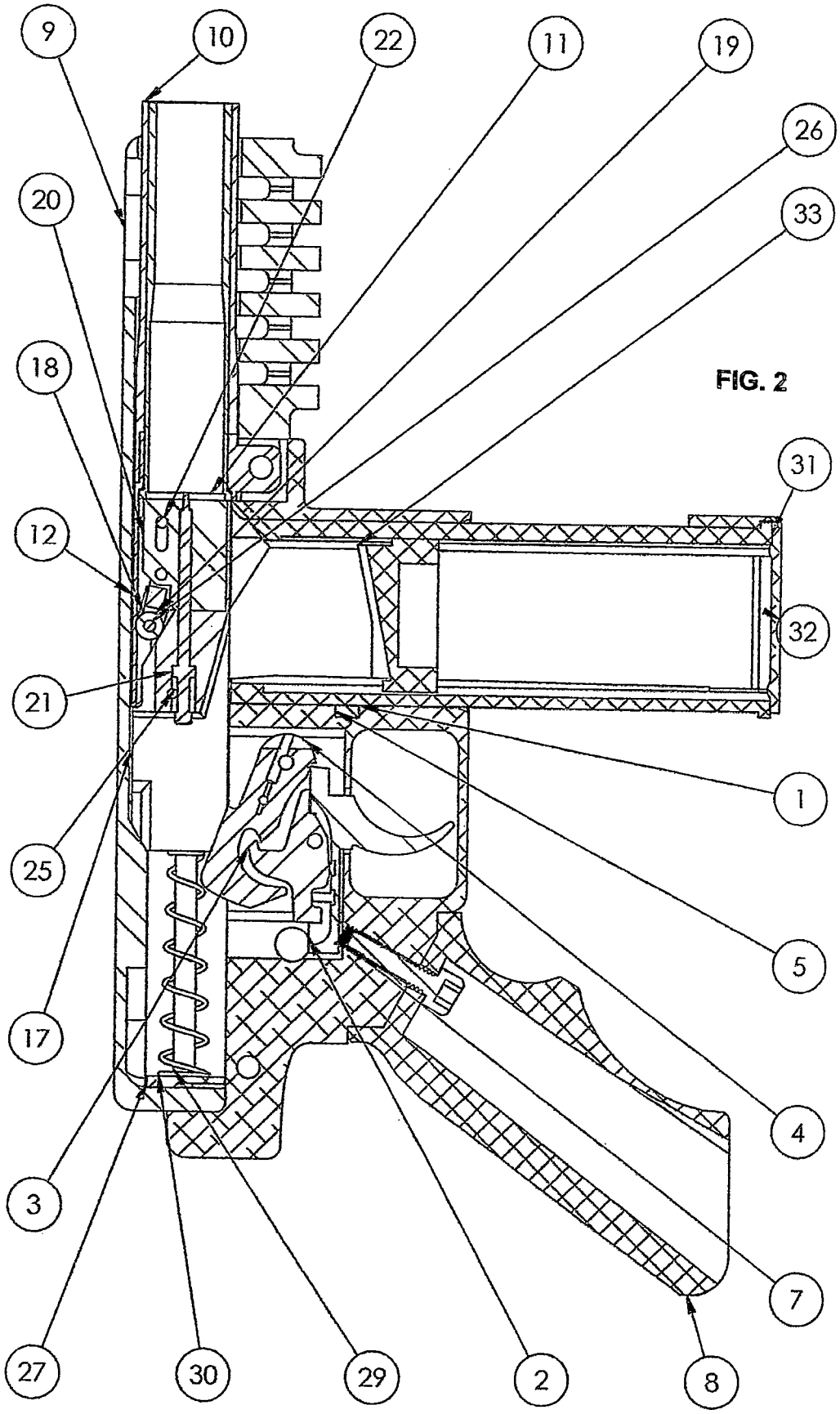
Figure 3A:
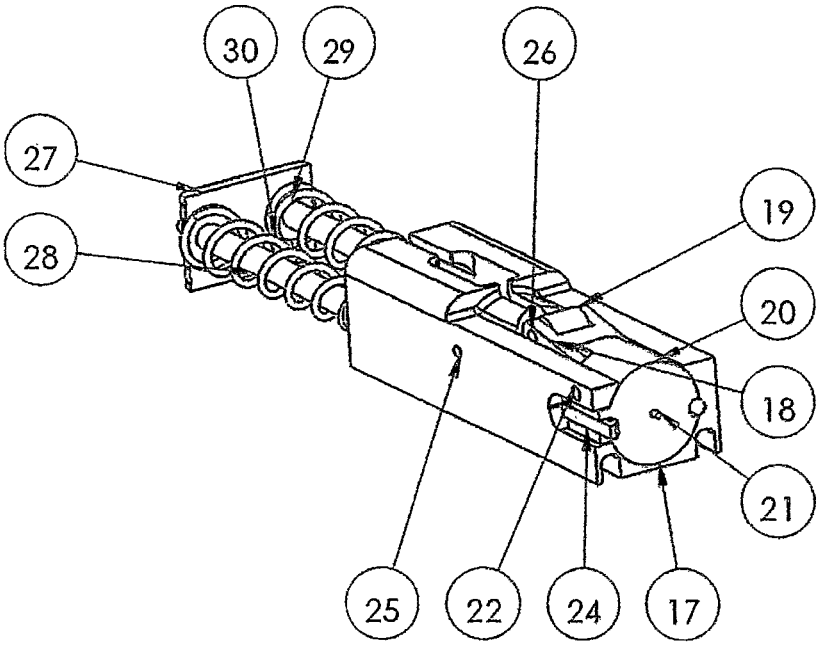
Figure 3B:
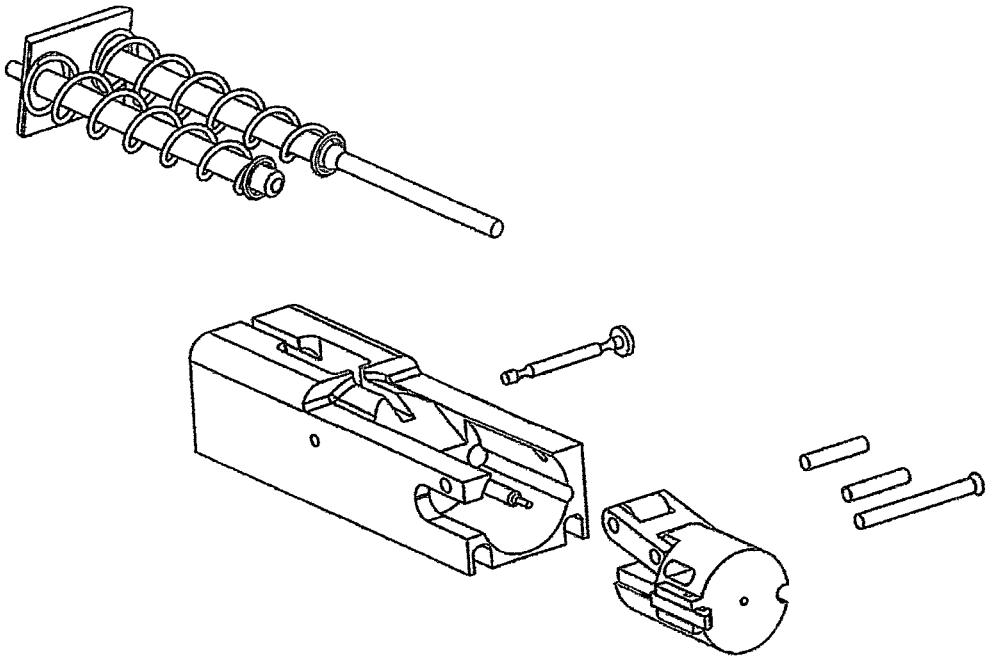
Figure 4:
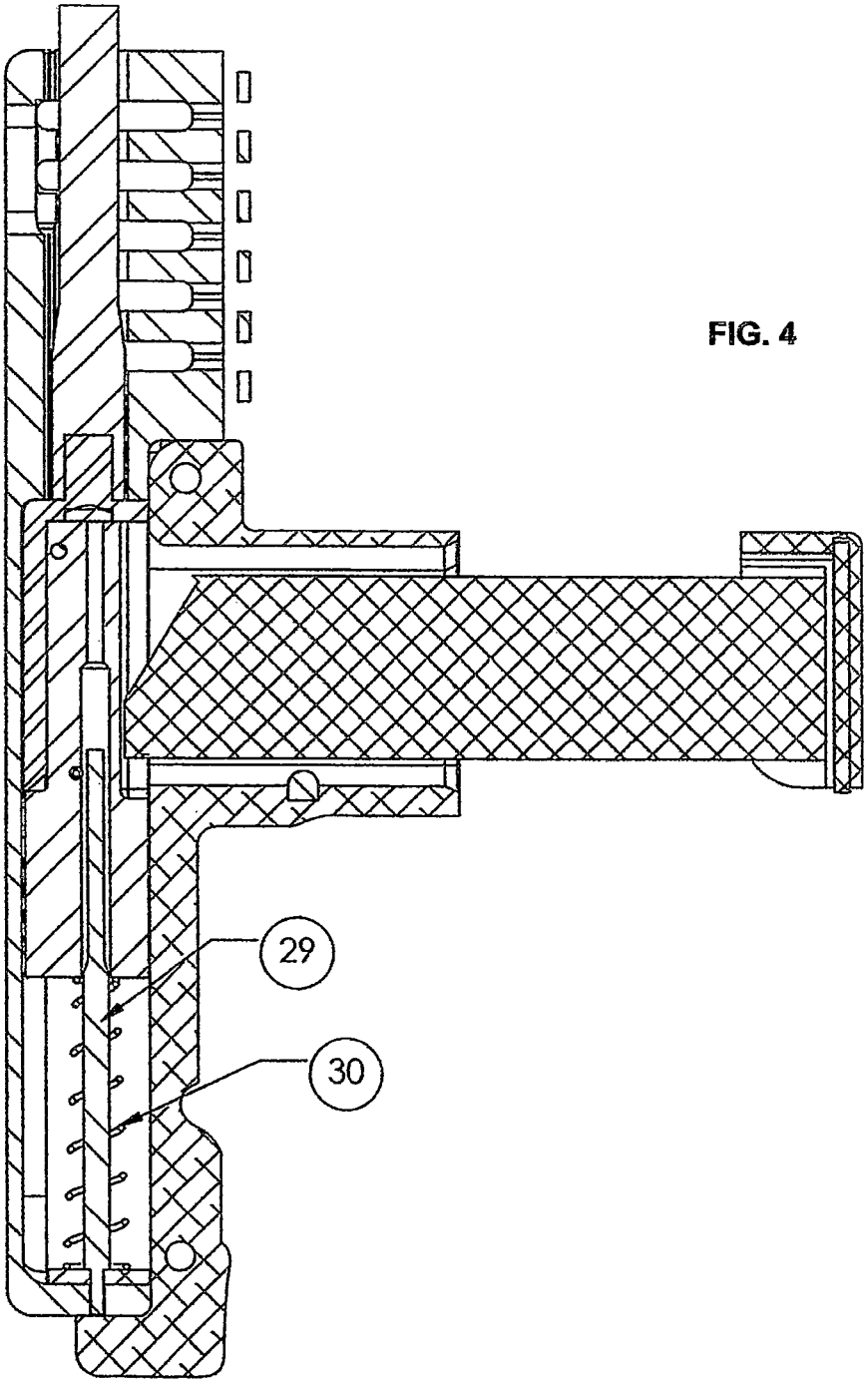
Figure 5:
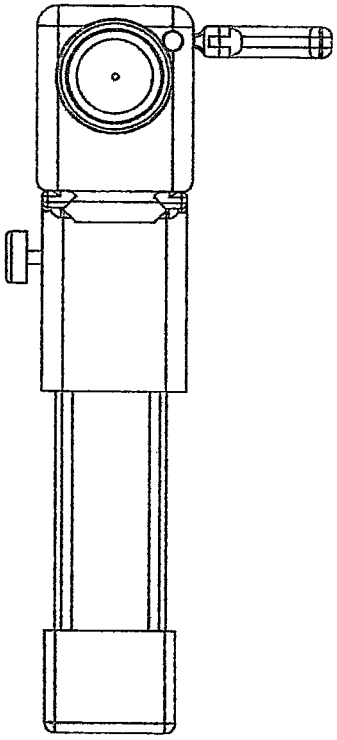
Figure 6:
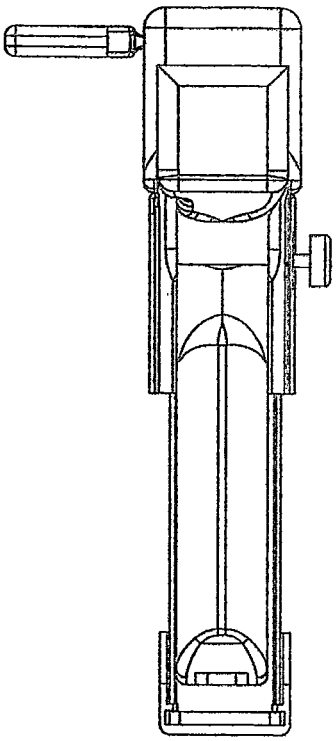

Cycle of operations and detailed description of the inventive firearm (referring to numbered (#) parts within the FIGURES eg FIG. 2 (FIG. 2) and FIG. 3 (FIG. 3)) is shown in the drawings and described as following:

1. Firing—with the safety in fire position and trigger depressed the hammer of the trigger assembly will strike the firing pin (FIG. 2 #21) located in the bolt carrier group (FIG. 3A). This will detonate a shotpistol shell located in the chamber portion of the barrel (FIG. 2 #11) of the firearm. This detonation provides the energy needed to force the bolt rearward.
2. Unlocking—the detonation of the shotpistol shell provides an impulse, carried thru the locked bolt assembly, to the bolt carrier group (BCG) this impulse moves the BCG to the rear. Which, due to the design of the bolt carrier group, allows the roller bolt locking mechanism to be moved from the locked position to the unlocked position. As the shotpistol shell detonates, the impulse transmitted to the BCG through the bolt (FIG. 3A #20) provides a delay (proportional to the distance the BCG must travel before the roller reaches the unlock position) in which the pressure inside the barrel is significantly decreased preventing the separation of the head of the shell case. This is known as the roller delayed blowback method of inertial operation.
3. Extracting—Immediately following the unlocking stage, the extractor claw (FIG. 3A #24) that secures the spent shotpistol shell base to the bolt face in tandem with the inertia derived from the detonation of the shotpistol shell and residual discharge gas pressure moves the expended shotshell casing rearward from the barrel chamber.
4. Ejecting—As the bolt continues rearward and reaches a predetermined distance, the ejection length left guide rod (FIG. 3A #29) protrudes from the bolt face. This protrusion acting mechanically with the continued rearward motion of the BCG mounted extractor claw imparts an angular force to the moving spent casing. The resulting angular velocity coupled with the lifting energy of the magazine assembly propels the spent casing out of the ejection port (FIG. 1 #9A), simultaneously, decoupling the extractor claw. As the spent shell is rotating out, the top fresh shell is moved into pre-chambering position by the action of the springs within the magazine.
5. Cocking—As the bolt carrier group travels rearward, the hammer and trigger slide along beneath the bolt carrier group within the hammer channel until the trigger mechanism is reset into a ready or cocked state.
6. Feeding—As the rearward momentum of the BCG is stopped by the compression of the bolt buffer springs and contact with end of travel elastic buffers (FIG. 4

#30) the BCG will begin to move forward as the energy stored in the buffer springs is released by rebound. As this energy propels the BCG forward the bolt face will encounter the top of the base of the shotpistol shell in the pre-chambering position of the magazine, propelling it forward and out of the magazine along the shotpistol shell feed ramp to the chamber. This motion continues forward until the shotpistol shell is centered and within the barrel chamber.

7. Chambering—As the shotshell movement into the chamber is completing, the extractor claw will seat on the shotshell casing base. The continued forward momentum of the BCG pushes the shotshell into the chamber of the barrel in preparation for firing.
8. Locking—as the fresh shotshell is chambered, the bolt locking roller is pushed up into its locked position by the angled face of the BCG. This prevents the bolt from moving rearward until the BCG moves rearward due to the impulse from firing or the BGC is moved rearward by the manual charging rod.

Upper Receiver Assembly

The upper receiver assembly FIG. 2, sized for the shotpistol shell gauge and the recoil movement, comprises a machined shell that will contain the carrier bolt assembly, the smooth bore barrel, the manual charging assembly, the bolt guide rods and the recoil springs. The preferred design contains a multitude of open slots machined into the nose of the upper receiver to facilitate the removal of heat and provide an optional modular rail. The slots are preferably vertical, but any angle or shapes are allowed. A larger oval-like slot is provided on the top of the assembly 0.56 inches from the upper assembly muzzle end and extending at least 1.5 inches toward the trigger end, the horizontal dimension being at least the outer diameter of the barrel. This provides for the barrel to be inserted or removed. An additional opening in the upper receiver assembly opposite the ejection guide rod is provided for passage of spent shells and is preferably on the right horizontal surface.

Lower Receiver Assembly

The lower receiver assembly FIG. 2, sized for the shotpistol shell gauge and the recoil movement, comprises a machined body having a pistol grip, trigger assembly, a mechanical lock to retain the magazine during operation, and a removable shotpistol shell magazine forward of the trigger and perpendicular to the barrel suitable for containing a multitude of shotpistol shells therein. The rear outside vertical surface above the grip is sized to accommodate an optional wrist brace attachment.

Manual Charging Assembly

To provide a manual means of chambering a shell, an off-hand side charging handle is used. An object of the invention is to provide for the manual chambering of a shell while maintaining functional control of the firearm. A channel machined into the upper assembly and a handle attached to the bolt carrier assembly that moves rearward to retract the bolt carrier assembly allows for the insertion of a shell into the chamber. This optionally lockable mechanism is preferred to be independent of the bolt carrier assembly, and is thus nonreciprocating during firing, and most preferred to be independent of the bolt carrier assembly and where the handle can be folded 90 degrees to facilitate use of a sidearm holster.

Pistol Weight

This design requires 12 gauge and larger shotpistol shells where all the components are sized to accommodate the size of the shotpistol shell, while the grip and trigger remain the same. And where the pistol weight, the barrel length, the propellent charge, and the total projectile weight are balanced to provide a single hand controllable pistol during discharge. Preferably, where the pistol weight is under 7 ibs, more preferably under 6 lbs and most preferably between 5 and 5.2 lbs.

Bolt Carrier Group

The bolt carrier group is sized to the diameter and the length of the shotpistol shell. To illustrate, for 12-gauge 1.75 inch long shells, the bolt stroke was calculated to be approximately 2 inches to eject spent shells and cycle a fresh shell into the chamber. To minimize overall pistol length, this size shell design uses a 3.75-inch bolt carrier group which reciprocates along 2 guide rods. The right guide rod (looking at the bolt face) (FIG. 3A #29) provides additional ejection assistance for the heavy spent shells. This is accomplished by providing a longer guide rod on the side of the bolt opposite the ejection opening that protrudes through an open channel in the face of the bolt as it nears the end of its rearward motion. This rod contacts the spent shell and provides a rotational force around the extraction claw (mounted to the opposite side) to the spent shell as the shell and bolt approach their rearward limit. The right ejection guide rod is by necessity longer with a total length no longer than that necessary to rotate the spent shell past the forward end of the ejection opening. It is also necessary to provide an ejection opening in the upper chamber sufficient to allow passage of the elongated spent shell and the radius of arc of the rotating spent shell.

Delayed Blowback System

Roller system (FIG. 3A #18 and #19) operates to delay the opening of the breech to a predetermined time when the gas pressure is safe but sufficient to cycle the bolt carrier assembly. Reference U.S. Pat. No. 7,299,737. In this system, the angle of the ramp under the roller system and the roller and nest dimensions determines how far the bolt carrier group will move before it and the attached bolt are free to recoil. The object is to delay the bolt carrier group and the bolt free recoil until the projectiles leave the muzzle of the barrel and barrel gas pressure is rapidly dropping. Typical free recoil delays are a few milliseconds.

The detonation impulse and the gas pressure in the barrel pushes the bolt carrier group (BCG) and bolt along the guide rods against springs. These springs around the guide rods provide a resisting force which slows the momentum of the bolt and BCG and returns them forward, loading the next shell. The characteristics of the spring action during the recoil are selected to best match the discharge characteristics of the load. Additional, rearward travel limit devices (for example stiff springs or elastic bumpers) located in the space between bolt carrier group and the inter rear surface of the upper receiver assembly speed the rebound of the BCG and lessen mechanical stress on the overall assembly.

Trigger

As the bolt travels back the trigger mechanism is reset. Any suitable trigger can be utilized but the AR15 mechanism is preferred due to all the well-known advantages that it provides.

Grip

Any suitable pistol grip can be solidly attached to the lower receiver assembly and angled as in the AR15 style. The bottom portion of the grip can optionally be weighted with dense metal to help counteract rotation after firing. The detailed features of a pistol grip that maximize the hand grip stability/control are well known in the art.

Barrel

Smooth bore shotgun barrels shorten to required length and machined to include a properly sized shell chamber and selected to accommodate the desired shotpistol shell gauge and length may be used. However, barrel wall thickness for shells larger than 12-gauge can be appropriately reduced when the propellent and shot mass are sized to the shotpistol recoil energy limits. The length of the barrel should be as short as possible to facilitate the use as a side arm but long enough to achieve the desired direction and exit speed of the projectile assembly. For example, using a 1.75 inch long 12-gauge shotpistol shell the barrel minimum length after the shell chamber is 18.5 mm×4=74 mm (~3.1 inches). From the other discussions above, it should be clear that the length of the barrel must be carefully balanced with the propellent and shot loads (that together produce "kickback") and the bolt unlock delay (that provides safe yet effective recoil impulse to the bolt carrier group).

Magazine

The magazine internal dimensions are sized to provide smooth internal movement of the selected gauge shotpistol shells. The shells may be offset within the magazine to allow more shells to fit into a shorter but wider space. The lifting springs under the magazine follower FIG. 2 #33 are sized to provide sufficient lifting energy to the column of selected shotpistol shells and may be nested with additional shorter springs to avoid excessive compression force for a fully loaded magazine. The standard shell retention top and feed ramps are sized to the selected shell gauge by methods well known in the art. The magazine release and mounting fixtures of both the lower receiver assembly and the magazine are selected from those well known in the art. That is, a spring restrained unlock button and forward release shelf and the corresponding engagement surfaces on the magazine. The final lifting of the magazine to the locked position compresses the magazine spring by contact between the bolt carrier group and the top fresh shell.

Example BCG and Bolt design detail for 1.75-inch long 12-gauge shotpistol shell

1. Guide rod number and dimensions (see FIGS. 4, 3A, and 3B)
   a. There are, preferably, two guide rods both are made from A2 tool steel or similar material. Looking from the barrel towards the back plate of the upper receiver the left-hand guide rod is from 2.85 inches to 3.2 inches in length, preferably 3 inches in length. The right-hand guide rod is preferably 4.72 inches in total length. However, the wider portion of the guide rod length can vary from 3.2 inches to 2.85 inches (see FIG. 3B). The smaller diameter portion of the guide rod must be modified to ensure the overall length of the rod is between 4.75 inches and 4.70 inches. The spent shell is ejected using the combination of the push from the slender section of the right-hand guide rod that slides through the retracting bolt to contact the rear of the spent shell and the pivot on the concave shell rim grip on the left of the bolt. The momentum of the bolt after firing imparts an angular velocity to the spent shell that is pushed by the right-hand guide rod, pulled by the extractor claw, and lifted by the magazine spring to send the spent shell through the ejection port opening.
   b. Minimizing the mass of the firing pin and ensuring that the springs used for pushing the bolt back into the ready position have a combined spring constant less than 241 pounds in prevents the firing pin from attaining the force necessary to detonate the primer due to the reload cycle (known as slamfiring).
   c. The springs are any suitable material provided they show spring constants between 31 and 51 lb/in.
2. The roller delayed blow back system comprises a roller of 0.30 inches diameter (FIG. 3A #19), a BCG ramp angle of 30 degrees (FIG. 3B), and an upper receiver assembly roller nest depth of 0.14 inches.

Although a specific embodiment of the present invention is described in detail above, the description is not intended to limit the invention to the specific forms of embodiments disclosed therein since they are to be recognized as illustrative rather than restrictive and it will be obvious to those skilled in the art that the invention is not so limited. In the art of pistol design, there are numerous known methods to attach parts to create assemblies, select materials of construction, position assemblies and magazines together and to provide proven features, any of these may be incorporated into the inventive design without departing from spirt and scope of the invention. Patents cited are incorporated by reference.

What is claimed:

1. A semiautomatic smooth-bore barrel shotpistol shell pistol comprising upper and lower receiver assemblies, and a smooth-bore barrel; said upper receiver assembly, bolt carrier assembly, and bolt contain an inertial delayed blowback assembly; said upper receiver assembly having a recoil spring assembly and terminal recoil bumper mounted thereon and a bolt carrier assembly slidably mounted therein; said recoil spring assembly comprising one standard recoil rod, one longer ejection length recoil rod to eject a spent shell, two recoil springs, each spring mounted concentrically on each recoil rod; said bolt carrier assembly rides and is guided by the two recoil rods via cylindrical bores along its horizontal axis, said cylindrical bores optionally penetrating the bolt face, said bolt face is adapted to engage with a cartridge chamber formed on the entry end of said barrel; said bolt carrier assembly containing a firing pin and a cartridge extraction claw; said upper assembly containing a shell ejection port opposite the ejection length recoil rod side and, optionally, a wrist brace assembly mounted above the pistol grip; said lower assembly comprising a pistol grip, trigger assembly, and a removable shotpistol shell magazine forward of the trigger and perpendicular to the barrel suitable for containing a multitude of shotpistol shells therein; said shotpistol shell pistol weighting between 5 and 10 pounds.

2. The semiautomatic smooth-bore barrel pistol of claim 1 wherein the inertial delayed blowback assembly is a delayed blowback roller assembly.

3. The semiautomatic smooth-bore barrel pistol of claim 2 wherein the pistol is size is selected from 12 gauge to 40 mm shotpistol shells.

4. The semiautomatic smooth-bore barrel pistol of claim 3 wherein the shotpistol shells are 1.75 inch long.

5. The semiautomatic smooth-bore barrel pistol of claim 4 wherein the pistol weights between 4 and 6 pounds unloaded.

6. The semiautomatic smooth-bore barrel pistol of claim 5 wherein the pistol weights between 5 and 5.4 pounds.

7. The semiautomatic smooth-bore barrel pistol of claim 1 wherein shotpistol shells contain a multitude of metal pellets.

8. The semiautomatic smooth-bore barrel pistol of claim 1 wherein the shotpistol shells contain a multitude of non-metallic pellets.

9. The semiautomatic smooth-bore barrel pistol of claim 6 wherein the non-metallic pellets possess adhesive properties.

10. The semiautomatic smooth-bore barrel pistol of claim 1 wherein shotpistol shells contain crowd control loads.

11. The semiautomatic smooth-bore barrel pistol of claim 1 wherein the pistol grip and trigger assembly are of the AR15 design.

12. The semiautomatic smooth-bore barrel pistol of claim 1 wherein the lower receiver is modified to mount a pistol wrist brace.

13. The semiautomatic smooth-bore barrel pistol of claim 3, wherein said cylindrical bores are positioned horizontally to the center of the vertical cross section of said bolt carrier.

14. The semiautomatic smooth-bore barrel pistol of claim 13, wherein the ejection length recoil rod is positioned and sized in length to rotate the spent shell casing past the barrel end of the ejection port.

15. The semiautomatic smooth-bore barrel pistol of claim 6, wherein the pistol grip and trigger assembly are of the AR15 design.

16. The semiautomatic smooth-bore barrel pistol of claim 2 wherein the pistol is sized for 12-gauge shotpistol shells.

17. The semiautomatic smooth-bore barrel pistol of claim 16, wherein said cylindrical bores are positioned horizontally to the center of the vertical cross section of said bolt carrier, the ejection length recoil rod is positioned and sized in length to rotate the spent shell casing past the barrel end of the ejection port, and the pistol grip and trigger assembly are of the AR15 design.

* * * * *